US006213808B1

(12) United States Patent
Whatmore et al.

(10) Patent No.: US 6,213,808 B1
(45) Date of Patent: Apr. 10, 2001

(54) METHOD OF JOINING ELECTRICAL CONDUCTORS AND AN APPARATUS FOR PRACTICING THIS METHOD

(76) Inventors: Gregory Jay Whatmore, 25 Shelton Ave., Harmelia, Edenvale; Errol James Whatmore, 4 Lincoln Lane, Khyber Rock Village, Woodmead, Sandton, both of (ZA)

( * ) Notice: Subject to any disclaimer, the term of this patent is extended or adjusted under 35 U.S.C. 154(b) by 0 days.

(21) Appl. No.: 09/417,037

(22) Filed: Oct. 12, 1999

(30) Foreign Application Priority Data

Oct. 13, 1998 (ZA) ..... 98/9309

(51) Int. Cl.[7] ..... H01R 4/24
(52) U.S. Cl. ..... 439/417; 439/521; 439/901
(58) Field of Search ..... 439/417, 404, 439/409, 449, 459, 452, 453, 454, 455, 456, 464, 465, 467, 470, 471, 472, 473, 157, 521, 901

(56) References Cited

U.S. PATENT DOCUMENTS 3,803,530 * 4/1974 Lapraik ..... 439/471
5,947,762 * 9/1999 Katsuma ..... 439/468

OTHER PUBLICATIONS

Four Page Utilux Sales Brochure Entitled: "Snap Con Moisture Resistant Connectors".

* cited by examiner

*Primary Examiner*—Paula Bradley
*Assistant Examiner*—Tho D. Ta
(74) *Attorney, Agent, or Firm*—Woodcock Washburn Kurtz Mackiewicz & Norris LLP

(57) ABSTRACT

The invention provides an electrical housing having a cover portion 14, and a base portion (not shown) defining recesses for receiving electrical connectors 24. Each connector has a casing 26 defining a nozzle portion 28 through which terminations of electrical conductors 30 are receivable into the casing 26. The casing 26 holds captive a displaceable element 34 resembling a cylindrical plunger. The element 34 co-operates with a metal blade located within the casing 26 to strip off the insulation of the conductors 30 and join them electrically when the element 34 is urged into the casing. In use, a tool formation 40 forming part of the cover portion 14 is positioned over the displaceable element 34. When a downward force is applied to the cover portion 14 the tool portion 40 effectively urges the element 26 into its final position, thereby joining the conductors 30 electrically to each other. The cover portion 14 is conveniently secured to its matching base portion to form an electrical enclosure for the connectors 24.

15 Claims, 2 Drawing Sheets

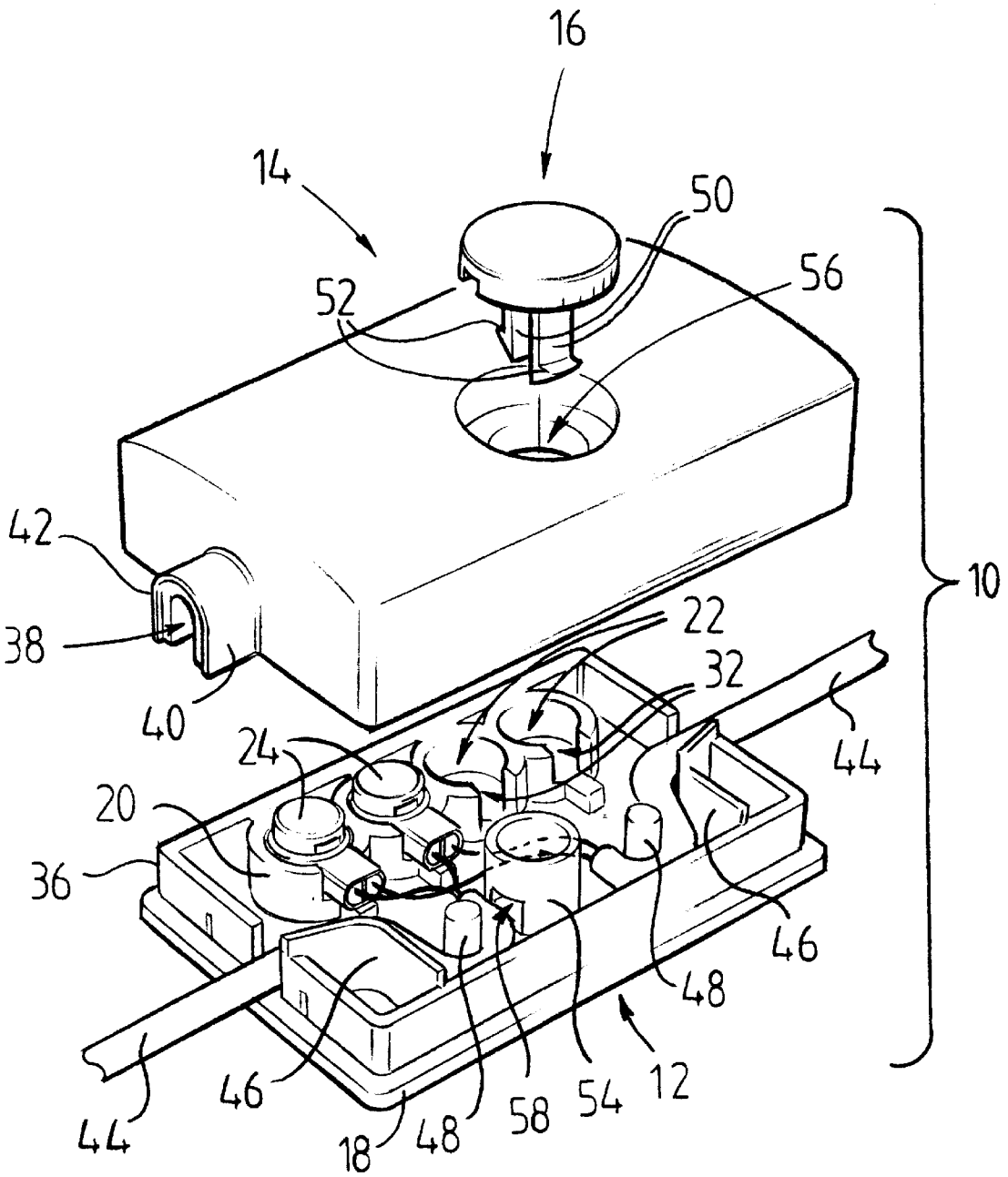
1

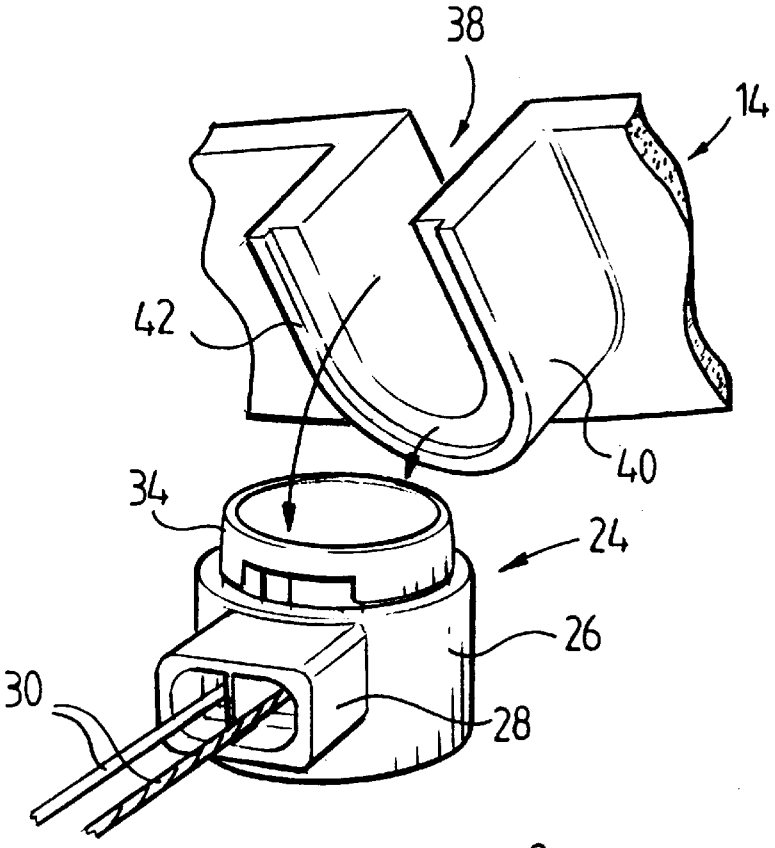
2
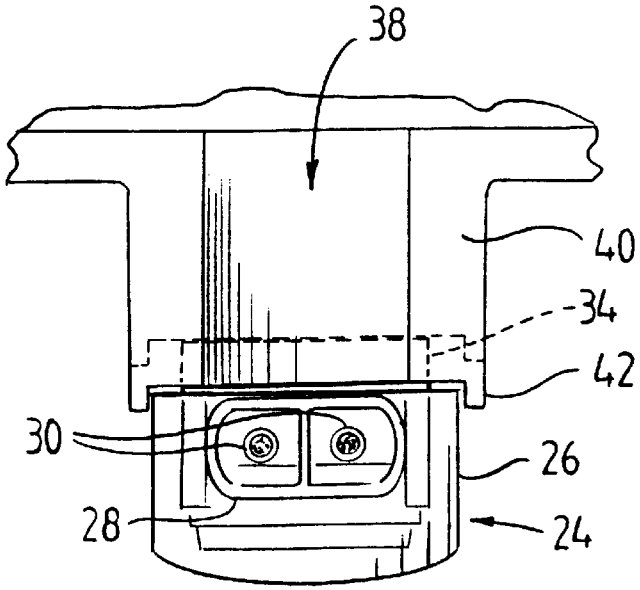
3

METHOD OF JOINING ELECTRICAL CONDUCTORS AND AN APPARATUS FOR PRACTICING THIS METHOD

FIELD OF THE INVENTION

This invention relates to a method of joining electrical conductors and an apparatus for practising this method.

BACKGROUND OF THE INVENTION

The provision of a telephone service generally involves routing a cable having multiple electrical conductors from an external network connection into a building where the service is required.

In the past externally mounted terminal blocks have been used for linking a cable coming from a telephone pole, for example, to conductors leading into the building concerned. Each terminal block may include an array of metal strips embedded in an insulating body, with each strip having a pair of screws for securing the terminations of respective conductors.

Other connecting systems include terminal blocks comprising a body of insulating material equipped with built-in metallic fasteners having notched cutting edges for piercing the electrical insulating sleeves surrounding the conductors in order to establish the required electrical contact. These systems eliminate the previously required installation step of stripping the insulation off conductor ends before joining them.

Connectors having exposed metal portions remain susceptible to moisture penetration, and resultant undesirable stray electrical currents. More recent connecting systems accordingly provide individual connectors, each having an insulating body encasing a displaceable blade-like metal element. In use the metal element first strips the insulation off the terminations of electrical conductors, and then forms an electrical link between them.

The present invention seeks to provide a method and an apparatus to facilitate and simplify the installation of electrical cables, and joining their respective conductors as required.

SUMMARY OF THE INVENTION

The present invention provides a method of joining electrical conductors to each other by means of existing connectors which are receivable in a common housing having a base portion and a matching cover portion, and each connector includes a casing holding captive a displaceable element for locking together the terminations of the conductors, the said method including the steps of

- inserting respective terminations of the conductors into corresponding apertures defined by the casing of each connector;
- positioning each connector in a complementary recess formed by the base portion of the housing; and
- applying an external force to the displaceable element of each connector by means of a tool which is operable by means of the cover portion of the housing until the displaceable element electrically joins together the terminations of the respective conductors.

The steps set out above are conveniently applied sequentially to join the respective conductors of at least 2 multicored cables with each other. An installation process involving these steps may include a final step of securing the cover portion of the housing to the base portion to form a weatherproof enclosure for the connectors and their associated conductors.

The invention extends to an electrical housing for joining electrical conductors by means of existing connectors, wherein each connector has a casing holding captive a displaceable element for joining together terminations of at least two conductors at a time, the said housing including

- a base portion defining complementary recesses for respectively receiving the connectors;
- a cover portion matching the base portion to form an enclosure for accommodating the connectors; and
- a tool which is operable by the cover portion during use to apply an external force to the displaceable element of each connector in order to join together the conductor terminations located within each connector.

The base portion may include a mounting plate supporting tubular elements defining recesses for the connectors.

The cover portion preferably fits in complementary relationship on to the base portion. The housing preferably includes securing means for securing the cover portion to the base portion during use.

The cover portion may define at least one port for inserting a cable comprising 2 or more conductors.

The tool may be integrally connected to the housing, and arranged immediately adjacent to at least one port. The tool may include a peripheral ridge formation matching the external dimensions of the casing of each connector to allow the tool to be centred over the displaceable element before any force is applied to the displaceable element.

In other embodiments of the invention the tool may be temporarily located in a cable port in the housing, and removed after use.

BRIEF DESCRIPTION OF THE DRAWINGS

The invention is described below by way of example with reference to the accompanying diagrammatic drawings, in which FIG. 1 shows an exploded perspective view of an electrical housing according to the present invention;

FIG. 2 shows a perspective view on an enlarged scale, illustrating the application of a tool forming part of the housing shown in FIG. 1; and FIG. 3 shows a schematic view of an electrical connector used in conjunction with the present invention, illustrating more fully the application of the tool shown in FIG. 2.

DESCRIPTION OF A PREFERRED EMBODIMENT OF THE INVENTION

In the accompanying drawings reference numeral 10 generally identifies an electrical housing according to the present invention. The housing 10 includes a base portion 12, a matching cover portion 14 and a locking device 16 for securing the cover portion to the base portion.

The base portion 12 includes a rectangular mounting plate 18 of a moulded plastics material, which supports 4 upstanding tubular elements 20. Each tubular element 20 defines a socket 22 for receiving an electrical connector 24 of known design. Connectors of this kind are commercially available from France, and are sold as telecommunication connectors under the trade name ETON.

Each connector 24 has an outer casing of a moulded plastic material forming a cylindrical portion 26 which is integrally connected to a nozzle portion 28 for receiving the terminations of an electrical conductor 30, as illustrated in FIG. 2. In use the nozzle portion 28 of each connector 24 nests in a corresponding recess 32 in its associated tubular element 20.

A displaceable locking element 34 resembling a cylindrical plunger is held captive by the outer cylindrical portion 26 of the connector casing. In use, the element 34 co-operates with a metal blade (not shown) arranged within the connector casing in transverse relationship to the nozzle portion 28.

When downward pressure is applied to the displaceable element 34 the blade tends to fold the terminations of the conductors 30 located within the connector casing over a static plate (not shown) in order to prevent inadvertent, subsequent extraction of the conductors 30. This step is conveniently performed manually.

The conductors 30 only become fully joined after the application of further pressure to the displaceable element 34. As the element 34 advances into the connector casing it performs a shearing action on the folded portion of each conductor 30. In doing this the movable blade strips any outer insulating material from the conductors 30 while maintaining continuous, simultaneous electrical contact with their respective metal cores.

Each connector 24 may be optionally filled with a non-conducting grease, which is expelled in extrusion-fashion from the nozzle portion 28 of the connector as the displaceable element 34 is urged into the connector casing. The electrical connection between the conductors 30 is accordingly rendered substantially moisture proof.

The final actions on the displaceable element 34 generally require more force than can be exerted manually in order to overcome any inherent frictional resistance. The present invention provides a convenient tool for this purpose, which is operable by means of the cover portion 14 of the housing 10.

The cover portion 14 is generally rectangular in configuration, and is preferably made of a moulded plastics material. An upstanding flange formation 36 on the mounting plate 18, which is arranged adjacent to its peripheral edges, serves to locate the housing 14 during use.

The cover portion 14 defines two opposing ports 38 having an inverted U-shaped profile, for inserting cables containing multiple conductors 30. Each port 38 is surrounded by an outwardly projecting tool formation 40, having a regular cross sectional profile throughout its length, and an inner wall generally coinciding with the profile of the ports 38.

Each tool formation 40 further defines a generally U-shaped ridge 42 which coincides with the outer peripheral area of the formation. The function of the tool formation 40 is best understood with reference to FIGS. 2 and 3.

FIG. 2 shows a connector 24 having 2 conductors 30 located in the nozzle 28 and provisionally locked in position in the manner described above. The cover portion 14 of the housing 10 is manipulated so that one of the tool formations 40 is positioned immediately above the connector 24, as demonstrated in FIG. 2.

The inner edges of the ridge 42 are generally dimensioned to pass with clearance over the outer peripheral region of the cylindrical portion 26 of the connector 24. The adjacent surface of the tool formation 40 is sufficiently wide to maintain steady contact with the displaceable element 34 during use.

Once a downward force is manually applied to the cover portion 14 the tool formation 40 gradually advances from an initial position depicted in broken outline in FIG. 3 to a final position in which the upper surface of the displaceable element 34 lies virtually flush with the adjacent surface of the cylindrical portion 26 of the connector 24.

At this stage the movable blade inside the connector is in intimate contact with the metal cores of both conductors 30, and their terminations are firmly locked in place, and electrically joined to each other. The connectors 24 are conveniently positioned in respective sockets 22, as illustrated in FIG. 1. The mounting plate 18 accordingly provides a solid backing for each connector 24 before the final locking force is applied. Using the tool formation 40 on the cover portion 14 in conjunction with the base portion 12 in the manner described above dispenses with the need for specialised crimping tools or the like to firmly lock each connector during installation.

The conductors 30 are contained inside incoming cables 44 which pass through respective gaps in the flange formation 36 on the mounting plate 18. Two deflection plates 46 guide the cables around corresponding pins 48, which are integrally connected to the mounting plate 18. These pins provide relief for the cable terminations against any external, tensile forces applied to the cables 44.

Once all required connections between respective conductors 30 have been established in the manner described above the housing 14 is lowered on to the mounting plate 18. The cables 44 eventually pass through the ports 38 in the housing 14, and the flange formation 36 nests with slight clearance inside the housing.

The locking device 16 has a pair of resilient prongs 50 with catches 52 which are receivable in a corresponding socket formed by an upstanding tubular member 54 on the mounting plate 18. The tubular member 54 is located immediately below an aperture 56 in the housing 14 through which the prongs 50 are insertable.

Once the locking device 16 is pushed fully downwardly the catches 52 engage the tubular member 54 by way of opposing lateral recesses 58 cut out of the tubular member. The cover portion 14 is accordingly locked in position, denying any unauthorised access to the cable terminations within the junction box 10. Any subsequent access is only feasible by destroying the locking device 16.

The electrical housing 10 described above lends itself to various modifications and adaptations. It is feasible, for example, to provide up to 10 connector sockets per electrical housing for relatively large numbers of telephone installations. The corresponding size of the ports 38 will necessarily increase to the extent that a correspondingly larger tool formation would no longer fit on to the connectors 24.

In this case it is preferable to provide a detachable insert, preferably of a moulded plastics material, which is temporarily locatable in a corresponding port in order to apply the required force to the connectors 24 during use. Electrical housings according to the present invention are preferably sold as complete kits. If a detachable tool is required, this may be conveniently discarded after use.

Each electrical housing may further be provided with double-sided adhesive tape for securing the mounting plate 18 to a selected support structure or substrate. In this way housings and telephone lines can be installed with comparative ease using only the contents of each kit.

A skilled reader will appreciate that the embodiments described above permit even further modifications and adaptations without dispensing with the elements set out under the summary of the invention. The scope of the accompanying claims should accordingly not be construed as being limited in any manner by the features of the preferred embodiments described above.

What is claimed is:

1. An electrical housing for joining electrical conductors, wherein each conductor has its own termination, by means of at least one connector, wherein each connector has a casing holding captive a displaceable element for joining together at least two conductor terminations at a time, comprising:

a base portion comprising a mounting plate which supports at least one recess for respectively receiving the connectors;

a cover portion matching the base portion to form an enclosure for accommodating the connectors during use; and a tool formation outwardly projecting from the cover portion having an outer peripheral area of the tool formation defining a surface conforming with the external dimensions of the displaceable element for maintaining contact with the displaceable element, said tool formation being operable by the cover portion during use to apply an external force to the displaceable element of each connector in order to join together the conductor terminations located within each connector.

2. The electrical housing assembly according to claim 1 wherein the recesses are defined by tubular formations into which the connectors are receivable.

3. The electrical housing assembly according to claim 1, which further includes a securing means for securing the cover portion on the base portion.

4. The electrical housing assembly according to claim 1 in which the cover portion defines a port for inserting an electrical cable.

5. The electrical housing assembly according to claim 4 in which the tool, during use, is arranged immediately adjacent to the port.

6. The electrical housing assembly according to claim 5 in which the tool is integrally connected to the cover portion.

7. The electrical housing according to claim 6 in which the tool includes a peripheral ridge formation matching the external dimensions of the connectors.

8. An electrical housing for joining electrical conductors, wherein each conductor has its own termination, by means of existing connectors, wherein each connector has a casing holding captive a displaceable element for joining together at least two conductor terminations at a time, comprising:

a base portion comprising a mounting plate which supports upstanding tubular recesses for respectively receiving the connectors;

a cover portion matching the base portion to form an enclosure for accommodating the connectors during use; and a tool formation having a U-shaped profile outwardly projecting from the cover portion having a regular cross-sectional profile throughout its length and a U-shaped ridge portion at an outer peripheral area of the tool formation, said U-shaped ridge portion is operable by the cover portion during use to apply an external force to the displaceable element of each connector in order to join together the at least two conductor terminations located within each connector.

9. The electrical housing assembly according to claim 8, which further includes a securing means for securing the cover portion on the base portion.

10. The electrical housing assembly according to claim 8 in which the cover portion defines a port for inserting an electrical cable.

11. The electrical housing assembly according to claim 10 in which the tool, during use, is arranged immediately adjacent to the port.

12. A method of joining electrical conductors, wherein each conductor has its own termination, by means of existing connectors which are receivable in a common housing having a base portion and a cover portion matching the base portion and comprising a tool formation outwardly projecting from the cover portion, and wherein each connector includes a casing holding captive a displaceable element for locking together the conductor terminations, the tool formation having a surface for maintaining steady contact with the displaceable element, said method comprising:

inserting the respective conductor terminations into corresponding apertures defined by the casing of each connector;

positioning each connector in a complementary recess defined by the base portion of the housing; and applying an external force to the displaceable element of each connector by means of the tool formation by means of the cover portion of the housing until the displaceable element electrically joins together the conductor terminations of the respective conductors.

13. The method according to claim 12 further comprising the step of securing the cover portion of the housing to the base portion.

14. A method of joining electrical conductors, wherein each conductor has its own termination, by means of existing connectors which are receivable in a common housing having a base portion comprising a mounting plate which supports upstanding tubular recesses for respectively receiving the connectors and a matching cover portion, the matching cover portion having a tool formation having a U-shaped profile outwardly projecting from the cover portion and a regular cross-sectional profile throughout its length, and a U-shaped ridge portion at an outer peripheral area of the tool formation, the U-shaped ridge portion having an inner and outer edge, wherein each connector includes a casing holding captive a displaceable element for locking together the conductor terminations, the casing defining apertures for receiving terminations of an electrical conductor, the method comprising:

inserting respective conductor terminations into the corresponding apertures defined by the casing of each connector;

positioning each connector in the complementary upstanding tubular recess defined by the base portion of the housing;

positioning the cover portion of the housing over the connector such that the tool formation is positioned immediately above the connector such that the inner edge of the ridge passes with clearance over an outer peripheral region of the connector casing; and applying an external force to the displaceable element of each connector by means of the cover portion's tool formation until the displaceable element electrically joins together the conduct or terminations of the respective conductors.

15. The method according to claim 14 further comprising the step of securing the cover portion of the housing to the base portion.

* * * * *